US006805929B2

(12) United States Patent
Koga et al.

(10) Patent No.: US 6,805,929 B2
(45) Date of Patent: Oct. 19, 2004

(54) RECORDING PAPER AND IMAGE RECORDING METHOD USING THE SAME

(75) Inventors: Chizuru Koga, Ebina (JP); Kiyoshi Hosoi, Ebina (JP)

(73) Assignee: Fuji Xerox Company, Limited, Tokyo (JP)

( * ) Notice: Subject to any disclaimer, the term of this patent is extended or adjusted under 35 U.S.C. 154(b) by 98 days.

(21) Appl. No.: 10/228,215

(22) Filed: Aug. 27, 2002

(65) Prior Publication Data

US 2003/0048344 A1 Mar. 13, 2003

(30) Foreign Application Priority Data

Aug. 31, 2001 (JP) ..... 2001-262968

(51) Int. Cl.[7] ..... B41M 5/00

(52) U.S. Cl. ..... 428/32.11; 347/105; 428/32.13; 430/124; 430/126

(58) Field of Search ..... 347/105; 428/32.11, 428/32.13; 430/124, 126

(56) References Cited

U.S. PATENT DOCUMENTS 6,063,538 A * 5/2000 Hayashi et al. ..... 430/124

FOREIGN PATENT DOCUMENTS

| | | |
|---|---|---|
| JP | A 6-219038 | 8/1994 |
| JP | A 7-257017 | 10/1995 |
| JP | B2 2943927 | 6/1999 |
| JP | A 2000-85239 | 3/2000 |

* cited by examiner

*Primary Examiner*—Bruce H. Hess
(74) *Attorney, Agent, or Firm*—Oliff & Berridge, PLC

(57) ABSTRACT

A recording paper usable in both inkjet recording and electrophotographic recording, and an image recording method using the recording paper. The recording paper includes a base paper that is composed mainly of pulp fibers, contains a filler, and is coated with a cationic resin on one or both sides, wherein surface electric resistivity at 22° C. and 55% relative humidity is $1.0\times10^{9}$ to $1.0\times10^{11}$ Ω and volume electric resistivity at 22° C. and 55% relative humidity is $1.0\times10^{10}$ to $1.0\times10^{12}$ Ω·cm.

19 Claims, No Drawings

RECORDING PAPER AND IMAGE RECORDING METHOD USING THE SAME

BACKGROUND OF THE INVENTION

1. Field of the Invention

The present invention relates to a recording paper, to which no special coating has been applied (so-called plain paper) and that is suitable for use in both inkjet recording and electrophotographic recording, and to an image recording method using the recording paper.

2. Description of the Related Art

Inkjet recording is characterized in that coloration is easy, noise at the time of recording and energy consumption are low, and manufacturing costs of printers therefor can be kept low. Because of these characteristics, inkjet recording has come to be widely used in recent years, not only in homes but also in offices. Inkjet recording has also come to be increasingly used together with electrophotographic recording apparatus, such as laser printers and copiers.

Recording media such as plain paper, coated paper and glossy paper for inkjet recording, white film, and transparent film are used in inkjet recording. Particularly when inkjet recording is employed in a laser printer or copier in an office or the like, printing is conducted most often on plain paper, which can be generally used in electrophotographic recording apparatus and is easily available at a low cost. Enhancing the recording suitability of plain paper in inkjet recording is therefore extremely important. However, there have been the following problems (1) to (4) when printing is conducted on plain paper in conventional inkjet recording.

(1) A phenomenon known as feathering occurs, in which ink flows out along the fibers of the paper. Such feathering significantly impairs black letter image quality in particular.
(2) Plain paper is generally treated with a size (water-repelling agent). For this reason, ink absorption is retarded and bleeding occurs between colors at regions where mutually different colors meet.
(3) It is difficult for coloring material to remain on the surface of the paper, and color-forming performance is not sufficient.
(4) Since water-soluble coloring material is used, water resistance of recorded images is insufficient.

In order to alleviate these problems, Japanese Patent Application Laid-Open (JP-A) No. 7-257017 discloses a method in which, using an ink that includes a water-soluble dye, recording is done on a paper including a substance having an ionicity opposite to that of the water-soluble dye in the ink. According to this method, it is possible to obtain ink fixability, sufficient image density, and images having excellent color reproducibility without bleeding when color images are recorded. Moreover, images have excellent water resistance are obtainable.

However, in this method, surface and volume electric resistivity of the paper drop when ionic chemicals are added in order to obtain sufficient image density. As a result, there are instances where toner transfer is poor and image quality worthy of practical use cannot be obtained in electrophotographic recording, whereby the paper cannot be used as a common paper. Meanwhile, although defective transfer does not occur if the amount of the ionic chemical substance added is reduced, the reduction impairs image quality such as print density and color formability at the time of inkjet printing.

In order to alleviate this problem, JP-A No. 2000-85239 proposes a plain paper that can be used in both inkjet recording and electrophotographic recording by adhering a cationic resin (cationic equivalent: 3 to 8 meq/g) in an amount of 0.5 to 2.0 g/sm to set surface electric resistivity to $1.0\times10^{9}$ to $9.9\times10^{13}$ Ω. However, when a chemical is coated on the plain paper using an ordinary size-press method, as described in the examples thereof, volume electric resistance concomitantly decreases even if the surface electric resistance is in the above-mentioned range. For this reason, defective transfer occurs in electrostatic recording (electrophotographic recording). Moreover, when the coating amount of the cationic resin is close to the lower limit, so that defective transfer does not occur, satisfactory inkjet image quality cannot be obtained in terms of color formation, print density, and the like. JP-A No. 6-219038 proposes a recording paper having a surface pH of 6.5 to 7.8 and surface electric resistance of $1.0\times10^{9}$ to $1.0\times10^{11}$ Ω, but the same problems occur.

Japanese Patent No. 2943927 proposes a plain paper having a volume specific resistance of $1.0\times10^{11}$ Ω·cm or less at 20° C. and 65% relative humidity. However, this plain paper is proposed from the viewpoint of paper conveyability, and when the volume specific resistance is less than $1.0\times10^{9}$ Ω·cm, defective toner transfer occurs. In addition, satisfactory inkjet image quality and water resistance cannot be obtained because the paper is not coated with a cationic resin.

SUMMARY OF THE INVENTION

It is a task of the present invention to solve the aforementioned conventional problems and to achieve the following object. Namely, it is an object of the invention to provide a recording paper that can be used in both inkjet recording and electrophotographic recording so that, when the paper is printed by inkjet recording, optical density and color formability are high, there is little feathering and bleeding between colors, and images have excellent water resistance, and when the paper is printed by electrophotographic recording using such apparatus as laser printers and copiers, defective toner transfer does not occur and clear images can be obtained. It is also an object of the invention to provide an image recording method using this recording paper.

As a result of extensive research in regard to this task, the present inventors found that penetration into a base paper by a coating solution that contains a cationic resin and is applied to the surface of the base paper is a factor far more important than the mere amount of the solution coated on the surface. That is, the inventors found that distributing the cationic resin in the vicinity of a surface layer of the base paper by minimizing penetration of the coating solution into the base paper when the cationic resin is applied to the surface is effective both for improving image quality in inkjet recording and for securing toner transferability in electrophotographic recording. The inventors came to focus their attention on surface electric resistivity and volume electric resistivity at 22° C. and 55% relative humidity as an indicator to measure the penetration of the coating solution containing the cationic resin (i.e., the distribution of the cationic resin in the vicinity of the surface layer). The inventors also came to focus their attention on a corrected St öckigt degree of sizing in order to alleviate feathering and bleeding between colors.

According to a first aspect of the invention, there is provided a recording paper comprising a base paper that is composed mainly of pulp fibers, contains a filler, and is coated with a cationic resin on one or both sides, wherein surface electric resistivity at 22° C. and 55% relative humidity is $1.0\times10^{9}$ to $1.0\times10^{11}$ Ω and volume electric resistivity at 22° C. and 55% relative humidity is $1.0\times10^{10}$ to $1.0\times10^{12}$ Ω·cm, with a corrected Stöckigt degree of sizing being no less than 10 seconds and no more than 40 seconds.

According to a second aspect of the invention, there is provided a recording paper whose smoothness is no less than 40 seconds and no more than 100 seconds, and whose texture index is no less than 20.

According to a third aspect of the invention, there is provided a method of electrophotographically recording an image, comprising the steps of: uniformly charging a surface of an electrostatic latent image support; exposing the surface of the electrostatic latent image support to light, to thereby form an electrostatic latent image; developing the electrostatic latent image formed on the surface of the electrostatic latent image support, using an electrostatic charge image developing agent, to form a toner image; transferring the toner image onto a recording paper; and fixing the toner image on the recording paper, wherein the recording paper is the recording paper described above.

According to a fourth aspect of the invention, there is provided a method of inkjet recording an image, comprising jetting ink droplets onto a recording paper to record an image on the recording paper, wherein the recording paper is the recording paper described above.

DESCRIPTION OF THE PREFERRED EMBODIMENTS

Embodiments of the present invention will be explained below, though it should be understood that the invention is not restricted to these embodiments.

A recording paper of the invention comprises a base paper that is composed mainly of pulp fibers, contains a filler, and is coated with a cationic resin on one or both sides, wherein surface electric resistivity at 22° C. and 55% relative humidity is $1.0\times10^{9}$ to $1.0\times10^{11}$ Ω and volume electric resistivity at 22° C. and 55% relative humidity is $1.0\times10^{10}$ to $1.0\times10^{12}$ Ω·cm, with a corrected Stöckigt degree of sizing being no less than 10 seconds and no more than 40 seconds. The characteristics of the recording paper of the invention are that the surface electric resistivity and the volume electric resistivity, which indicate the penetration of the cationic resin into the base paper (i.e., the distribution of the cationic resin in the vicinity of the base paper surface layer), are held within the above-mentioned specific ranges and the corrected Stöckigt degree of sizing is held within a specific range. Therefore, the recording paper of the invention can be used in both inkjet recording and electrophotographic recording, and has high optical density and color forming performance. When the recording paper is printed with inkjet recording apparatus, images having excellent water resistance with minimal inter-color blur and feathering when prints are produced. When the recording paper is printed with electrophotographic recording apparatus such apparatus as a laser printer or a copier, defective toner transfer does not occur and clear image can be obtained.

In the recording paper of the invention, the surface electric resistivity at 22° C. and 55% relative humidity is $1.0\times10^{9}$ to $1.0\times10^{11}$ Ω. The surface electric resistivity is preferably $5.0\times10^{9}$ to $7.0\times10^{10}$ Ω and more preferably $5.0\times10^{9}$ to $2.0\times10^{10}$. The volume electric resistivity at 22° C. and 55% relative humidity is $1.0\times10^{10}$ to $1.0\times10^{12}$ Ω·cm. The volume electric resistivity is preferably $1.3\times10^{10}$ to $1.6\times10^{11}$ Ω·cm and more preferably $1.3\times10^{10}$ to $4.3\times10^{10}$ Ω·cm. In the invention, surface electric resistivity means resistance of the surface coated with the cationic resin.

Surface electric resistivity at 22° C. and 55% relative humidity and volume electric resistivity at 22° C. and 55% relative humidity respectively mean surface electric resistivity and volume electric resistivity obtained by measuring recording paper kept for 24 hours at 22° C. and 55% relative humidity and humidified, by a method in accordance with JIS-K-6911 in the same environment.

The surface electric resistivity and the volume electric resistivity in the recording paper of the invention are indicators of the penetration of the cationic resin into the base paper (i.e., the distribution of the cationic resin in the vicinity of the recording paper surface layer). Surface electric resistivity and volume electric resistivity are controlled by this penetration. Although the penetration of the cationic resin into the base paper varies depending on the type of material and the like, the penetration can be controlled by adjusting gas transmittance of the base paper, corrected Stöckigt degree of sizing of the base paper, and viscosity of a coating solution containing the cationic resin. The penetration of the cationic resin into the base paper can be also reduced by making the base paper and thereafter size pressing paper that has been dried without being size pressed.

If the degree of penetration of the cationic resin into the base paper is too high or too low, the distribution of the cationic resin in the vicinity of the recording paper surface layer is so poor that the surface electric resistivity and the volume electric resistivity fall outside the ranges specified above. More specifically, if the degree of penetration of the cationic resin into the base paper is too high, the volume electric resistivity drops to an extent that defective toner transfer tends to occur in electrophotography, and the color forming performance of color images tends to become poor in inkjet recording because the amount of the cationic resin remaining on the paper surface diminishes and it becomes difficult for the paper surface to retain colorants. On the other hand, if the degree of penetration is too low, the surface electric resistivity drops to an extent that defective toner transfer tends to occur in electrophotographic recording.

The corrected Stöckigt degree of sizing of the recording paper of the invention is 10 seconds to 40 seconds and preferably 20 seconds to 35 seconds. If the corrected Stöckigt degree of sizing is less than 10 seconds, the ability of the recording paper to be practically used in inkjet recording is impaired because the degree of feathering becomes so poor that fine characters become indiscernible and printed bar codes become unreadable. On the other hand, if the corrected Stöckigt degree of sizing degree exceeds 40 seconds, bleeding between colors occurs and color image quality becomes poor because ink penetration becomes retarded.

Corrected Stöckigt degree of sizing herein means a value obtained by measuring the Stöckigt degree of sizing according to JIS-P-8122:1976 in a standard environment (23° C. and 50% relative humidity) specified in JIS-P-8111:1998 and calibrating this Stöckigt degree of sizing on the basis of a 100 μm-thick recording paper. The reason the Stöckigt degree of sizing is used as it is is because the impact of the thickness of the recording paper cannot be eliminated. The "corrected Stöckigt degree of sizing" as defined herein is represented by the following equation (1).

$$\text{corrected Stöckigt degree of sizing} = \text{Stöckigt degree of sizing} \times (100/t)^2 \qquad \text{Equation (1)}$$

(where t is the thickness (μm) of the measured recording paper)

The corrected Stöckigt degree of sizing can be controlled by, for example, selecting the type of cationic resin or the type of binder to be used therewith, or by using a surface sizing agent.

The recording paper of the invention preferably has a smoothness of 40 seconds to 100 seconds, and more preferably 70 seconds to 100 seconds, from the standpoint of raising toner transferability and improving granularity in electrophotographic recording. If the smoothness is less than 40 seconds, granularity may become inferior. On the other hand, a paper having a smoothness exceeding 100 seconds is not desirable as the recording paper because, in order to obtain high smoothness, a high-pressure press is employed in a wet state when the paper is manufactured and, as a result, the opacity of the paper may be reduced.

The smoothness as used herein can be measured in accordance with JIS-P-8119:1998.

The recording paper of the invention preferably has a texture index of at least 20, and more preferably at least 30, from the standpoint of improving image quality in electrophotographic recording by reducing mottle. If the texture index is less than 20 seconds, image quality may be impaired by cloudy mottles because the penetration of toner into the paper becomes non-uniform when the toner is adhered by thermal fusion in electrophotographic recording.

The term "texture index" as used herein means a value obtained by measurement using a 3D Sheet Analyzer (M/K950) manufactured by M/K Systems, Inc. (MKS Corp.), in which the opening of the analyzer is set to a diameter of 1.5 mm, and a microformation tester (MFT). That is, texture index is obtained by attaching a sample of the recording paper onto a rotating drum in the 3D Sheet Analyzer and measuring, as differences in light amounts, local differences in basis weight in the sample with a with a light source disposed on the drum axis and a photodetector disposed outside the drum in correspond with the light source. The target range of the measurement in this case is set by the diameter of the aperture attached to the portion of the photodetector at which light enters. The differences in light amount (deviations) are then amplified, subjected to A/D conversion, and classified into 64 optically measured classes of basis weight. 1,000,000 pieces of data are taken per scan and histogram frequencies for the data are obtained. The maximum frequency (peak value) of the histogram is divided by the number of the classes, each having a frequency of 100 or more, selected out of the 64 classes corresponding to the very small basis weights and thereafter the value is divided by 100. The value obtained in this procedure is defined as texture index. The greater the texture index is, the better is the texture.

In the recording material of the invention, the base paper is composed mainly of pulp fibers and contains a filler.

Examples of the pulp fibers include chemical pulps. Specific examples thereof include hard wood bleached kraft pulp, hard wood unbleached kraft pulp, soft wood bleached kraft pulp, soft wood unbleached kraft pulp, hard wood bleached sulfite pulp, hard wood unbleached sulfite pulp, soft wood bleached sulfite pulp, and soft wood unbleached sulfite pulp as well as pulps produced by chemically treating fibrous materials such as wood, cotton, flax, kernel skin, or the like. Further examples of the pulp fibers include ground wood pulp which is obtained by mechanically pulping wood or chips, chemimechanical pulp which is obtained by mechanically pulping wood or chips impregnated with a chemical substance, and thermomechanical pulp which is obtained by pulping chips, which are in a slightly soft state by being digested, by means of a refiner. These pulps may be used as so-called virgin pulps, made up of these pulps alone, or used together with waste paper pulp as needed.

The virgin pulp is preferably bleached by an Elementally Chlorine Free (ECF) method, in which chlorine dioxide is used but a chlorine gas is not used, or by a Total Chlorine Free (TCF) method, in which ozone/hydrogen peroxide or the like is used but no chlorine compound is used at all.

The materials for waste paper pulp may include unprinted waste paper such as topmost white, special white, medium white, or white loss resulting from cut-off, loss paper, or edge-cut in a bookbinding, printing, cutting workshop, etc.; printed waste paper of high-quality such as printed or copied high-quality paper or high-quality coated paper; waste paper written with aqueous ink, oil ink, pencil, or the like; waste paper such as waste newspaper including inserts, e.g., printed high-quality paper, high-quality coated paper, medium-quality paper, medium-quality coated paper, etc., medium-quality paper, medium-quality coated paper, and rough paper.

The waste paper pulp is preferably obtained by bleaching the waste paper material with at least one of ozone and hydrogen peroxide. In order to obtain paper having a higher degree of whiteness, it is preferable that the proportion of the bleached waste paper pulp is no less than 50% and no more than 100% in the materials for the base paper. From the standpoint of reusing resources, it is more preferable that the proportion of the waste paper pulp is no less than 70% and no more than 100% in the materials for the base paper. The ozone acts to decompose fluorescent dyes or the like ordinarily present in high-quality paper. The hydrogen peroxide acts to prevent yellowing caused by alkali used in de-inking. In particular, it is known that a treatment combining both ozone and hydrogen peroxide not only facilitates the de-inking of waste paper but also raises the degree of pulp whiteness. Further, since these treatments effect the decomposition and removal of chlorine compounds remaining in the pulp, these treatments are very effective in reducing the content of organo-halogen compounds in chlorine-bleached pulp derived from waste paper.

The base paper contains a filler. The incorporation of the filler makes it possible to adjust opacity, whiteness, and surface properties. In particular, when it is desired to reduce the halogen content in the paper, the use of a halogen-free filler is desired. Examples of the filler include white inorganic pigments such as heavy calcium carbonate, light calcium carbonate, chalk, kaolin, calcined clay, talc, calcium sulfate, barium sulfate, titanium dioxide, zinc oxide, zinc sulfide, zinc carbonate, aluminum silicate, calcium silicate, magnesium silicate, synthetic silica, aluminum hydroxide, alumina, sericite, white carbon, saponite, calcium montmorillonite, sodium montmorillonite, and bentonite, etc.; organic pigments such as an acryl-based plastic pigment, polyethylene, a urea resin, etc.; and others. Besides, it is suitable to adjust the amount of the filler to be added based on the anticipated ash content of the waste paper material.

From the standpoint of controlling the penetration of the cationic resin into the base paper interior, the corrected St öckigt degree of sizing (the corrected Stöckigt degree of sizing of the base paper) prior to the coating of the cationic resin is preferably not less than 10 seconds but not more than 30 seconds and more preferably not less than 20 seconds but less than 30 seconds. If the corrected Stöckigt degree of sizing prior to the coating of the cationic resin is low, a large amount of the cationic resin penetrates the base paper, the volume electric resistivity is reduced and toner transferability may become inferior in electrophotographic recording, while the capability to fix the ink dye on the surface is impaired and color forming performance and density may be reduced in inkjet recording. If the corrected Stöckigt degree of sizing prior to the coating of the cationic resin is high, bleeding between colors becomes remarkable because the penetration rate of the ink into the base paper interior becomes extremely retarded and hands or cloth may be smeared because the drying of the ink becomes inferior. Examples of ways in which the corrected Stöckigt degree of sizing can be controlled include incorporating an internally-added sizing agent into the base paper. Examples of the internally-added sizing agent that can be used include a neutral rosin sizing agent, alkenyl succinic anhydride (ASA), alkenyl ketene dimer (AKD), and a petroleum resin sizing agent, which are all used in a neutral paper-making process.

From the standpoint of controlling the penetration of the cationic resin into the base paper, the gas transmittance of the base paper is preferably not less than 10 seconds but less than 30 seconds and more preferably not less than 10 seconds but less than 20 seconds. If the gas transmittance of the base paper is too high, ink penetrability in inkjet recording may be impaired, and bleeding between colors and a reduction in drying characteristics are likely to occur. On the other hand, if the gas transmittance of the base paper is too low, the volume electric resistivity is reduced and toner transferability may become inferior in electrophotographic recording, while the capability to fix the ink dye on the surface is impaired and color forming performance and density may be reduced in inkjet recording. The gas transmittance of the base paper can be adjusted by, for example, calendering the base paper prior to coating or by selecting the kind and amount of filler to be added.

In making the base paper, it is preferable to adjust the fiber orientation ratio within the range of 1.0 to 1.55, preferably within the range of 1.0 to 1.45, and more preferably within the range of 1.0 to 1.35. Such specific ranges make it possible to reduce curling of the paper after the paper is printed in inkjet recording.

Fiber orientation ratio refers to fiber orientation ratio based on ultrasonic transmission speed, and indicates a value obtained by dividing the ultrasonic transmission speed in MD (in a paper machine direction) by the ultrasonic transmission speed in CD (in a direction vertical to the paper machine direction). Fiber orientation ratio is expressed by the following equation.

fiber orientation ratio (T/Y ratio) based on ultrasonic transmission speed of a substrate=MD direction ultrasonic transmission speed÷CD direction ultrasonic transmission speed More specifically, fiber orientation ratio based on ultrasonic transmission speed can be measured using, for example, a Sonic Sheet Tester-210 (SST-210: manufactured by Nomura Shôji Co., Ltd.).

The recording paper of the invention comprises a base paper whose one side or both sides are coated with a cationic resin. This is because many of the hydrophilic colorants incorporated in the ink are generally anionic and react with the cationic substance to thereby fix and water-proof the dyes. One such suitable cationic resin is a copolymer of a hydrophilic monomer component, which has an amino group or a quaternary amino group capable of forming an insoluble salt by reacting with a sulfonic group, a carboxyl group or the like of the direct dye or acid dye in the ink, and a hydrophobic monomer component, or a salt thereof. If necessary, other components may be copolymerized. The copolymer may be a random polymer, a graft polymer, a block polymer, or the like.

Examples of the hydrophobic monomer component include styrene, styrene derivatives, vinyltoluene, vinyltoluene derivatives, vinylnaphthalene, vinylnaphthalene derivatives, butadiene, butadiene derivatives, isoprene, isoprene derivatives, ethylene, ethylene derivatives, propylene, propylene derivatives, alkyl esters of acrylic acid, and alkyl esters of methacrylic acid. Preferred hydrophobic monomer components are styrene, styrene derivatives, alkyl acrylates, and alkyl methacrylates. The number of carbon atoms of the alkyl group is 1 to 10 and preferably 1 to 6.

Examples of the other components include acrylamide, acrylamide derivatives, dimethylaminoethyl methacrylate, ethoxyethyl methacrylate, butoxyethyl methacrylate, ethoxytriethylene methacrylate, vinylpyrrolidone, vinylpyridine, polyoxyethylene-containing components such as alkyl ethers, methoxypolyethylene glycol methacrylate, and polyethylene glycol methacrylate, and hydroxy-containing components such as hydroxymethyl methacrylate, hydroxyethyl methacrylate, and vinyl alcohol.

Examples of the hydrophilic monomer having an amino group or a quaternary amino group include compounds obtained by quaternizing N,N-dimethylaminoethyl methacrylamide, N,N-dimethylaminoethyl acrylamide, N,N-dimethyl acrylamide, N,N-dimethyl methacrylamide, N,N-dimethylaminopropyl acrylamide, N,N-dimethylaminopropyl methacrylamide, or the like. For the quaternization, methyl chloride, methyl iodide, dimethyl sulfate, benzyl chloride, epichlorohydrin, and the like can be used.

Examples of the compounds that are primary, secondary, or tertiary amine salts, and quaternary ammonium salts include dodecyltrimethylammonium chloride, dodecylbenzyltrimethylammonium chloride, dodecyldimethylbenzylammonium chloride, stearyltrimethylammonium chloride, benzyltributylammonium chloride, benzalkonium chloride, cetyltrimethylammonium chloride, an ethylene oxide adduct of higher alkylamine (e.g., dihydroxyethylstearylamine) as an amine salt. Examples of pyridinium salt type compounds include cetylpyridinium chloride, cetylpyridinium bromide, and the like. Examples of imidazoline-type cationic compounds include 2-heptadecenyl-hydroxyethylimidazoline and the like. Alternatively, a so-called cationic surfactant may also be used.

When the cationic resin is used, generally it is used as a mixture with a binder. Examples of the binder include oxidized starch, starch esterified by phosphoric acid, homemade modified starch, cationized starch or other modified starch, polyethylene oxide, polyacrylamide, sodium polyacrylate, sodium alginate, hydroxymethyl cellulose, carboxymethyl cellulose, methyl cellulose, polyvinyl alcohol, and derivatives thereof. These materials may be used alone or in combination. However, it should be noted that the binder for use in the invention is not limited to these materials.

The corrected Stöckigt degree of sizing of the recording paper can be adjusted by the above-mentioned binder alone to the value necessary in the invention. However, when the adjustment of the corrected Stöckigt degree of sizing is not carried out sufficiently by the binder alone, a surface sizing agent may be used. Examples of the surface sizing agent that can be used include rosin sizing agents, synthetic sizing agents, petroleum resin sizing agents, neutral sizing agents, starch, and polyvinyl alcohol. It is preferable to use a halogen-free internally-added sizing agent or surface sizing agent if the reduction of the halogen content in the recording paper is desired. More specifically, rosin sizing agents, synthetic sizing agents, petroleum resin sizing agents, and neutral sizing agents can be used. It is preferable to use a neutral sizing agent from the standpoint of enhancing the preservability of the recording paper. The degree of sizing can be adjusted by the amount of the sizing agent added.

When a cationic resin is used, the viscosity of the coating solution containing the cationic resin is preferably not less than 5 mPa·s but less than 50 mPa·s and more preferably not less than 10 mPa·s but less than 50 mPa·s from the standpoint of controlling penetration of the cationic resin into the base paper. If the viscosity is too high, the penetration of the cationic resin into the base paper tends to be difficult. Conversely, if the viscosity is too low, the penetration of the cationic resin into the base paper tends to be excessive. The viscosity of the coating solution containing the cationic resin can be increased by using a combination of starch and polyvinyl alcohol and or/a derivative thereof as one of the above-mentioned binders.

The recording paper of the invention can be obtained by making the base paper, coating a cationic resin on one or both sides of the base paper by ordinary coating means such as a size press, shim size, gate roll, roll coater, bar coater, air knife coater, rod blade coater, blade coater, and drying the paper.

The recording paper of the invention can be suitably used both in electrophotographic recording and in inkjet recording (image recording method of the invention).

The method of electrophotographically recording an image is itself a known method. An example thereof includes uniformly charging the surface of an electrostatic latent image support, exposing the surface of the electrostatic latent image support to light so that an electrostatic latent image is formed, developing the electrostatic latent image formed on the surface of the electrostatic latent image support using an electrostatic charge image developing agent so that a toner image is formed, transferring the toner image onto a recording paper, and fixing the toner image on the image-receiving material. If necessary, the method may further include removing the electrostatic latent image remaining on the electrostatic latent image support surface and removing from the electrostatic latent image support surface residual toner, adherent paper powder, dirt, and the like. These steps can be carried out according to conventionally known methods, respectively.

The method of inkjet recording an image is itself a known method. An example thereof includes a method in which ink droplets are jetted onto a recording paper so as to record images on the recording paper. More specific examples include: thermal inkjet recording, in which the ink is heated so as to form bubbles and the pressure thus formed causes the ink liquid droplets to be jetted; a pressure pulse system (drop on-demand), in which the ink liquid droplets are jetted by vibratory pressure from a piezo-element or the like; a charge-controlling system, in which the ink liquid droplets are jetted by an electrostatic attracting force; and acoustic inkjet recording, in which electric signals are converted into acoustic beams and the ink is irradiated with the beams so that the radiation pressure causes the ink droplets to be jetted.

EXAMPLES

The present invention will be more specifically explained with reference to the following examples, though it should be understood that the invention is not restricted to these examples.

Example 1

Hard wood kraft pulp was bleached by an Elementary Chlorine Free (ECF) multistage bleaching process comprising an oxygen-bleaching step, an alkali-extracting step, and a treating step by vapor-phase chlorine dioxide. The pulp thus obtained was beaten to a freeness of 450 mL. The pulp was then incorporated, based on 100 parts by weight thereof, with 3 parts by weight of a bentonite filler, 3 parts by weight of a light calcium carbonate filler, and 0.1 parts by weight of an alkyl ketene dimer (AKD) internal size and the pulp base paper making. The paper thus obtained was size pressed using a coating solution (having a viscosity of 45 mPa·s) prepared by blending 93 parts by weight of water, 4 parts by weight of a cationized starch (Ace K manufactured by Oji Cornstarch Co., Ltd.), and 3 parts by weight of a cationic resin (Neofix RD-5 manufactured by Nicca Chemical Co., Ltd.) and thereafter calendered to smooth the surface. In this way, a recording paper was obtained.

Before being size pressed, the base paper was subjected to the measurement of the corrected Stöckigt degree of sizing and to the measurement of gas transmittance according to JIS-P-8117:1998. In addition, after the coating step, surface electric resistivity, volume electric resistivity, corrected St öckigt degree of sizing, texture index, and smoothness were measured according to the aforementioned methods, respectively. The same measurements were conducted in the following examples and comparative examples.

Example 2

Hard wood kraft pulp was bleached by a Total Chlorine Free (TCF) multistage bleaching process comprising a xylanase-treating step, an alkali-extracting step, a hydrogen peroxide-treating step, and an ozone-treating step. The pulp thus obtained was beaten to a freeness of 450 mL. The pulp was then incorporated, based on 100 parts by weight thereof, with 3 parts by weight of a kaolin filler, 6 parts by weight of a light calcium carbonate filler, and 0.2 parts by weight of an alkenyl succinic anhydride (ASA) internal size and the pulp base paper making. The paper thus obtained was size pressed using a coating solution (having a viscosity of 15 mPa·s) prepared by blending 93 parts by weight of water, 3 parts by weight of an oxidized starch (Ace A manufactured by Oji Cornstarch Co., Ltd.), 2 parts by weight of cation-modified polyvinyl alcohol (Gohsefimer manufactured by Nippon Synthetic Chemical Industry Co., Ltd.), and 2 parts by weight of a cationic resin (Neofix FY manufactured by Nicca Chemical Co., Ltd.) and thereafter calendered to smooth the surface. In this way, a recording paper was obtained.

Comparative Example 1

Soft wood mechanical pulp was bleached by hydrosulfite and was beaten to a freeness of 450 mL. The pulp was then incorporated, based on 100 parts by weight thereof, with 8 parts by weight of a light calcium carbonate filler and 0.02 parts by weight of an alkenyl succinic anhydride (ASA) internal size and the pulp base paper making. The paper thus obtained was size pressed using a coating solution (having a viscosity of 1.0 mPa·s) prepared by blending 97 parts by weight of water, 1 part by weight of an oxidized starch (Ace A manufactured by Oji Cornstarch Co., Ltd.), and 2 parts by weight of a cationic resin (Neofix FY manufactured by Nicca Chemical Co., Ltd.) and thereafter calendered to smooth the surface. In this way, a recording paper was obtained.

Example 3

Hard wood kraft pulp was bleached by an ECF process as in Example 2 and was beaten. The pulp was then incorporated, based on 100 parts by weight thereof, with 3 parts by weight of a light calcium carbonate filler, 3 parts by weight of a saponite filler, and 2 parts by weight of a neutral rosin size and the pulp base paper making. The paper thus obtained size pressed using a coating solution (having a viscosity of 20 mPa·s) prepared by blending 95 parts by weight of water, 3 parts by weight of cation-modified polyvinyl alcohol (Gohsefimer manufactured by Nippon Synthetic Chemical Industry Co., Ltd.), 1 part by weight of polyethylene glycol (PEG), and 1 part by weight of a cationic resin (Neofix IJ-450 manufactured by Nicca Chemical Co., Ltd.) and thereafter calendered to smooth the surface. In this way, a recording paper was obtained.

Example 4

Hard wood kraft pulp was bleached by a TCF process comprising an oxygen-treating step, an alkali-extracting step, a hydrogen peroxide-treating step, and an ozone-treating step and the pulp thus obtained was beaten. The pulp was then incorporated, based on 100 parts by weight thereof, with 3 parts by weight of a light calcium carbonate filler and 0.1 parts by weight of an alkyl ketene dimer (AKD) internal size and the pulp base paper-making. The paper thus obtained was size pressed using a coating solution (having a viscosity of 10 mPa·s) prepared by blending 95 parts by weight of water, 3 parts by weight of an oxidized starch (Ace A manufactured by Oji Cornstarch Co., Ltd.), and 2 parts by weight of a cationic resin (IJ150 manufactured by Nicca Chemical Co., Ltd.) and thereafter calendered to smooth the surface. In this way, a recording paper was obtained.

Comparative Example 2

Hard wood kraft pulp was bleached by a TCF process as in Example 3 and was beaten. The pulp was then incorporated, based on 100 parts by weight thereof, with 5 parts by weight of a light calcium carbonate filler, 3 parts by weight of a bentonite filler, and 0.05 parts by weight of an alkyl ketene dimer (AKD) internal size and the pulp base paper making. The paper thus obtained was size pressed using a coating solution (having a viscosity of 10 mPa's) prepared by blending 95 parts by weight of water, 4 parts by weight of nonionic polyvinyl alcohol (Kuraray Poval PVA117 manufactured by Kuraray Co., Ltd.), and 1 part by weight of a cationic resin (Neofix E-117 manufactured by Nicca Chemical Co., Ltd.) and thereafter to calendered to smooth the surface. In this way, a recording paper was obtained.

Comparative Example 3

Fine-quality waste paper was macerated and a de-inking agent (DI-767 manufactured by Kao Corporation) was added to the maceration product. After that, an ozone-bleaching treatment was carried out and further an alkali-treatment was carried out. After being aged, the product thus obtained was subjected to a flotation treatment to thereby remove printing ink, toner, etc. that were isolated from the pulp system. Finally, the product obtained in the above-described process was sufficiently washed in a washing machine. In this way, a waste paper pulp was prepared. The waste paper pulp was then incorporated, based on 100 parts by weight thereof, with 5 parts by weight of a kaolin filler, 5 parts by weight of a bentonite filler, and 0.1 parts by weight of an alkenyl succinic anhydride (ASA) internal size and the pulp base paper making. The paper thus obtained was size pressed using a coating solution (having a viscosity of 10 mPa·s) prepared by blending 95 parts by weight of water, 2 parts by weight of an oxidized starch (Ace A manufactured by Oji Cornstarch Co., Ltd.), and 3 parts by weight of a cationic resin (Neofix R-250 manufactured by Nicca Chemical Co., Ltd.). In this way, a recording paper was obtained.

Comparative Example 4

A commercially available electrophotographic recording paper (Paper J made by Fuji Xerox Co., Ltd.) was used as the recording paper of Comparative Example 4.

Comparative Example 5

A commercially available recording paper for common use in electrophotographic recording and in inkjet recording (Multi-use Paper made by Sharp Corporation) was used as the recording paper of Comparative Example 5.

Example 5

Hard wood kraft pulp was bleached by the TCF process as in Example 2 and beaten. The pulp was then incorporated, based on 100 parts by weight thereof, with 4 parts by weight of a light calcium carbonate filler and 0.2 parts by weight of an alkenyl succinic anhydride (ASA) internal size and the pulp base paper making. The paper thus obtained was size pressing using a coating solution (having a viscosity of 50 mPa·s) prepared by blending 92 parts by weight of water, 5 parts by weight of cation-modified polyvinyl alcohol (Gohsefimer manufactured by Nippon Synthetic Chemical Industry Co., Ltd.), and 3 parts by weight of a cationic resin (Neofix FY manufactured by Nicca Chemical Co., Ltd.) and thereafter calendered to smooth the surface. In this way, a recording paper was obtained.

Evaluation (Evaluation of Inkjet Prints)

In an environment of 23° C. and 55% relative humidity (RH), evaluation of prints was conducted with respect to the following items using an evaluation bench of multi-pass printing with four recording heads. Nozzle pitch was 800 dpi and drop amount was about 15 pl. The results are shown in Table 1.

Bleeding Between Colors

A print was made such that 2 cm-square patches of black ink and of color ink bordered each other. Color mixing of the print at boundaries was functionally assessed by 10 examiners. The criteria for evaluation were as follows.

◎: no color mixing
○: slight color mixing, but not enough to present problems in practical use
Δ: slight color mixing enough to present problems in practical use
X: unacceptable color mixing Feathering 8-point letters were printed in black ink. The print quality was visually inspected. The criteria for evaluation were as follows.

◎: no bleeding observed in kanji and kana characters
○: bleeding observed in minute parts of kanji and kana characters, but not enough to present problems in practical use
Δ: bleeding observed in parts of kanji and kana characters to an extent presenting problems in practical use
X: bleeding observed in kanji and kana characters Color-Forming Performance Color-forming performance on color solid patches was visually inspected one day after printing. The criteria for evaluation were as follows.

◎: sharpness equivalent to pigment-coated paper
○: far sharper than plain paper exclusively for electrophotographic use, although inferior to pigment-coated paper; no problems in practical use
Δ: color-forming performance equivalent to that of plain paper exclusively for electrophotographic use; not suitable for inkjet printing
X: color-forming performance equal or inferior to that of plain paper exclusively for electrophotographic use; cannot be practically used Water Resistance The patch density of 2 cm-squares that were printed in color ink was measured by a Macbeth densitometer. 24 hours after being printed, the printed product was immersed in water for 3 minutes and then taken out of the water. After drying, the density was measured again and the percentage of density retention of printed images was obtained. The percentage was used as the indicator of water resistance. The criteria for evaluation were as follows.

○: density retention not less than 85%
Δ: density retention not less than 50% but less than 85%
X: density retention less than 50[{]ps (Evaluation of Electrophotographic Prints)

Various recording papers were kept in an environment of 22° C. and 55% relative humidity for 24 hours so that the moisture contents thereof were adjusted. Using these papers, copy samples were obtained by means of a full-color copier (Acolor 936 manufactured by Fuji Xerox Co., Ltd.) and the following evaluations were conducted. The results are shown in Table 1.

Toner Transferability

The toner transferability in solid patches was visually inspected. The criteria for evaluation were as follows.

◎: no problems
Δ: defective transfer in some colors; presents problems in practical use
X: defective transfer in all colors Granularity Granularity of patches in halftone region was visually inspected. The criteria for evaluation were as follows.

◎: no problem
Δ: looks coarse; presents problem in practical use
X: looks seriously coarse; cannot be used practically Mottle Mottles in solid patches were visually inspected. The criteria for evaluation were as follows.

◎: no problem
Δ: some mottles; presents problems in practical use
X: mottles present across the entire patches; cannot be used practically

TABLE 1

| | Example 1 | Example 2 | Comparative Example 1 | Example 3 | Example 4 | Comparative Example 2 | Comparative Example 3 | Comparative Example 4 | Comparative Example 5 | Example 5 |
|---|---|---|---|---|---|---|---|---|---|---|
| Base paper | | | | | | | | | | |
| Corrected Stöckigt degree of sizing of base paper (in seconds) | 20 | 15 | 10 | 30 | 20 | 15 | 30 | unknown | unknown | 20 |
| Gas transmittance of base paper (in seconds) | 10 | 25 | 10 | 12 | 30 | 10 | 10 | unknown | unknown | 10 |
| Recording paper | | | | | | | | | | |
| Coating of cationic resin | yes (both sides) | yes (both sides) | yes (both sides) | yes (both sides) | yes (both sides) | yes (both sides) | yes (both sides) | no | yes (both sides) | yes (one side) |
| Surface electric resistivity (Ω) | $1.0 \times 10^{10}$ | $7.8 \times 10^{9}$ | $8.5 \times 10^{9}$ | $8.2 \times 10^{9}$ | $1.2 \times 10^{10}$ | $9.1 \times 10^{9}$ | $8.2 \times 10^{9}$ | $4.4 \times 10^{10}$ | $9.7 \times 10^{9}$ | $7.5 \times 10^{9}$ |
| Volume electric resistivity (Ω) | $5.0 \times 10^{10}$ | $2.3 \times 10^{10}$ | $6.5 \times 10^{9}$ | $1.0 \times 10^{10}$ | $8.0 \times 10^{10}$ | $4.1 \times 10^{9}$ | $1.2 \times 10^{10}$ | $1.7 \times 10^{11}$ | $2.0 \times 10^{10}$ | $5.0 \times 10^{10}$ |
| Corrected Stöckigt degree of sizing (in seconds) | 15 | 10 | 6 | 20 | 25 | 20 | 25 | 46 | 46 | 37 |
| Smoothness | 75 | 95 | 70 | 75 | 100 | 30 | 8 | 120 | 60 | 100 |
| Texture index | 35 | 38 | 35 | 30 | 30 | 30 | 10 | 26 | 20 | 30 |
| Inkjet system | | | | | | | | | | |
| Bleeding between colors | ◎ | ○ | ◎ | ○ | ○ | ◎ | ◎ | ○ | Δ | ○ |
| Feathering | ◎ | ◎ | X | ◎ | ◎ | X | ◎ | ◎ | Δ | ◎ |
| Color-forming performance | ◎ | ◎ | X | ◎ | ◎ | X | ◎ | X | Δ | ◎ |

TABLE 1-continued

| | Example 1 | Example 2 | Comparative Example 1 | Example 3 | Example 4 | Comparative Example 2 | Comparative Example 3 | Comparative Example 4 | Comparative Example 5 | Example 5 |
|---|---|---|---|---|---|---|---|---|---|---|
| Water resistance | ⊙ | ⊙ | Δ | ⊙ | ⊙ | Δ | ⊙ | X | ⊙ | ⊙ |
| Electro-photographic system | | | | | | | | | | |
| Toner transferability | ⊙ | ⊙ | Δ | ⊙ | ⊙ | X | ⊙ | ⊙ | ⊙ | ⊙ |
| Granularity | ⊙ | ⊙ | ⊙ | ⊙ | ⊙ | impossible to access | X | ⊙ | ⊙ | ⊙ |
| Mottle | ⊙ | ⊙ | ⊙ | ⊙ | ⊙ | impossible to access | X | ⊙ | Δ | ⊙ |

It can be seen from the results of Table 1 that the recording paper having surface electric resistivity, volume electric resistivity, and corrected Stöckigt degree of sizing, each falling in a specific range, leads to little feathering, little bleeding between colors, has high optical density, superior color-forming performance, and superior water resistance when the recording paper is printed in inkjet recording. Likewise, this recording paper does not cause defective toner transfer and provides clear images having better granularity and free from mottles when the recording paper is printed in electrophotographic recording.

As stated above, the invention can provide a recording paper characterized in that it can be used both in inkjet recording and in electrophotographic recording, has high optical density, high color-forming performance, minimal bleeding between colors and feathering, and images having excellent water resistance when prints are produced in inkjet recording, and the recording paper does not cause defective toner transfer and provides clear images when prints are produced in electrophotographic recording using such apparatus as a laser printer or a copier. The invention can also provide an image recording method using this recording paper.

What is claimed is:

1. A recording paper comprising a base paper that is composed mainly of pulp fibers, contains a filler, and is coated with a cationic resin on one or both sides, wherein surface electric resistivity at 22° C. and 55% relative humidity is $1.0\times10^{9}$ to $1.0\times10^{11}$ Ω and volume electric resistivity at 22° C. and 55% relative humidity is $1.0\times10^{10}$ to $1.0\times10^{12}$Ω·cm.

2. The recording paper of claim 1, wherein a corrected Stöckigt degree of sizing is no less than 10 seconds and no more than 40 seconds.

3. The recording paper of claim 2, wherein the surface electric resistivity at 20° C. and 55% relative humidity is $5.0\times10^{9}$ to $7.0\times10^{10}$Ω.

4. The recording paper of claim 3, wherein the surface electric resistivity at 22° C. and 55% relative humidity is $5.0\times10^{9}$ to $2.0\times10^{10}$Ω.

5. The recording paper of claim 2, wherein the volume electric resistivity at 22° C. and 55% relative humidity is $1.3\times10^{10}$ to $1.6\times10^{11}$Ω·cm.

6. The recording paper of claim 5, wherein the volume electric resistivity at 22° C. and 55% relative humidity is $1.3\times10^{10}$ to $4.3\times10^{10}$Ω·cm.

7. The recording paper of claim 2, wherein smoothness is no less than 40 seconds and no more than 100 seconds, and the texture index is at least 20.

8. The recording paper of claim 2, wherein the corrected Stöckigt degree of sizing is no less than 20 seconds and no more than 35 seconds.

9. The recording paper of claim 2, wherein gas transmittance of the base paper is no less than 10 seconds and less than 30 seconds.

10. The recording paper of claim 9, wherein the gas transmittance of the base paper is no less than 10 seconds and less than 20 seconds.

11. The recording paper of claim 2, wherein the degree of fiber orientation a the base paper is no less than 1.0 and no more than 1.55.

12. The recording paper of claim 11, wherein the degree of fiber orientation a the base paper is no less than 1.0 and no more than 1.35.

13. The recording paper of claim 2, wherein the cationic resin is a copolymer comprising a hydrophilic monomer component including an amino group or a quatemary amino group and a hydrophobic monomer component, or is a salt of the copolymer.

14. The recording paper of claim 13, wherein the hydrophobic monomer component is selected from the group consisting of styrene, a styrene derivative, an alkyl acrylate and an alkyl methacrylate.

15. A method of electrophotographically recording an image, comprising the steps of:

uniformly charging a surface of an electrostatic latent image support;

exposing the surface of the electrostatic latent image support to light, to thereby form an electrostatic latent image;

developing the electrostatic latent image formed on the surface of the electrostatic latent image support, using an electrostatic charge image developing agent, to form a toner image;

transferring the toner image onto a recording paper; and fixing the toner image on the recording paper, wherein the recording paper is a recording paper comprising a base paper that is composed mainly of pulp fibers, contains a filler, and is coated with a cationic resin on one or both sides, wherein surface electric resistivity at 22° C. and 55% relative humidity is $1.0\times10^{9}$ to $1.0\times10^{11}$Ω and volume electric resistivity at 22° C. and 55% relative humidity is $1.0\times10^{10}$ to $1.0\times10^{12}$Ω·cm.

16. A method of inkjet recording an image, comprising jetting ink droplets ont a recording paper to record an image on the recording paper, wherein the recording paper is a recording paper comprising a base paper that is composed mainly of pulp fibers, contains a filler, and is coated with a cationic resin on one or both sides, wherein surface electric resistivity at 22° C. and 55% relative humidity is $1.0\times10^{9}$ to $1.0\times10^{11}$Ω and volume electric resistivity at 22° C. and 55% humidity is $1.0\times10^{10}$ to $1.0\times10^{12}$Ω·cm.

17. A method of recording an image, comprising applying an image onto a recording paper, wherein the recording paper comprises a base paper that includes mainly pulp fibers, contains a filler, and is coated with a cationic resin on one or both sides, wherein surface electric resistivity at 22° C. and 55% relative humidity is $1.0\times10^{9}$ to $1.0\times10^{11}\Omega$ and volume electric resistivity at 22° C. and 55% relative humidity is $1.0\times10^{10}$ to $1.0\times10^{12}\Omega\cdot$cm.

18. The method of claim 17, wherein applying the image onto the recording p per comprises:

uniformly charging a surface of an electrostatic latent image support;

exposing the surface of the electrostatic latent image support to light, to form an eletrostatic latent image;

developing the electrostatic latent image formed on the surface of the electrostatic latent image support, using an electrostatic charge image developing agent, to form a toner image;

transferring the toner image onto the recording paper; and fixing the toner image on the recording paper.

19. The method of claim 17, wherein applying the image onto the recording paper comprises jetting ink droplets onto the recording paper to record the image on the recording paper.

* * * * *